US005106431A

United States Patent [19]

Nelson

[11] Patent Number: 5,106,431

[45] Date of Patent: Apr. 21, 1992

[54] PROCESS FOR CREATING HIGH STRENGTH TUBING WITH ISOTROPIC MECHANICAL PROPERTIES

[75] Inventor: Stanley R. Nelson, Minneapolis, Minn.

[73] Assignee: Alliant Techsystems Inc., Minnetonka, Minn.

[21] Appl. No.: 612,418

[22] Filed: Nov. 13, 1990

[51] Int. Cl.[5] ..... C21D 8/02

[52] U.S. Cl. ..... 148/12.3; 148/12 E; 148/12 EA; 148/125; 148/326; 148/328

[58] Field of Search ..... 148/12.3, 12 E, 12 EA, 148/125, 909, 326, 328, 12.7 N

[56] References Cited

U.S. PATENT DOCUMENTS

| | | | |
|---|---|---|---|
| 1,296,842 | 1/1932 | Offutt et al. . | |
| 1,924,099 | 8/1933 | Bain et al. . | |
| 2,028,996 | 1/1936 | Sautier . | |
| 2,220,652 | 11/1940 | Irmann . | |
| 2,286,064 | 6/1942 | Coxe . | |
| 2,892,702 | 6/1959 | Walton et al. | 148/326 |
| 2,958,618 | 11/1960 | Allen | 148/125 |
| 3,108,870 | 10/1963 | Brady et al. | 148/326 |
| 3,152,934 | 10/1964 | Lula et al. | 148/328 |
| 3,187,402 | 6/1965 | Duffield . | |
| 3,314,831 | 4/1967 | Hoenie et al. | 148/125 |
| 3,614,816 | 10/1971 | Weyhmuller et al. . | |
| 3,659,528 | 5/1972 | Santala . | |
| 3,706,118 | 12/1972 | Hilton et al. . | |
| 3,761,322 | 9/1973 | Winter et al. . | |
| 3,838,497 | 10/1974 | Rizzitano et al. . | |
| 3,873,375 | 3/1975 | Bolen et al. . | |
| 4,041,868 | 8/1977 | Rayle et al. . | |
| 4,494,461 | 1/1985 | Pryor et al. . | |
| 4,638,535 | 1/1987 | Pryor et al. . | |
| 4,762,559 | 8/1988 | Penrice et al. . | |

OTHER PUBLICATIONS

Rees, T. W. and L. C. Shaheen, "Metallic Tube Production", Encyclopedia of Materials Science and Engineering, Massachusetts Institute of Technology, vol. 4, pp. 2987–2989.

*Primary Examiner*—R. Dean
*Assistant Examiner*—Sikyin Ip
*Attorney, Agent, or Firm*—Haugen and Nikolai

[57] ABSTRACT

High strength alloy steel cartridge cases characterized by very high isotropic yield strength characteristics are produced from high temperature austenitic conditioned materials by subjecting the materials to a substantial one-pass draw operation and thereafter freezing the materials at approximately −100° F. prior to age hardening.

18 Claims, 4 Drawing Sheets

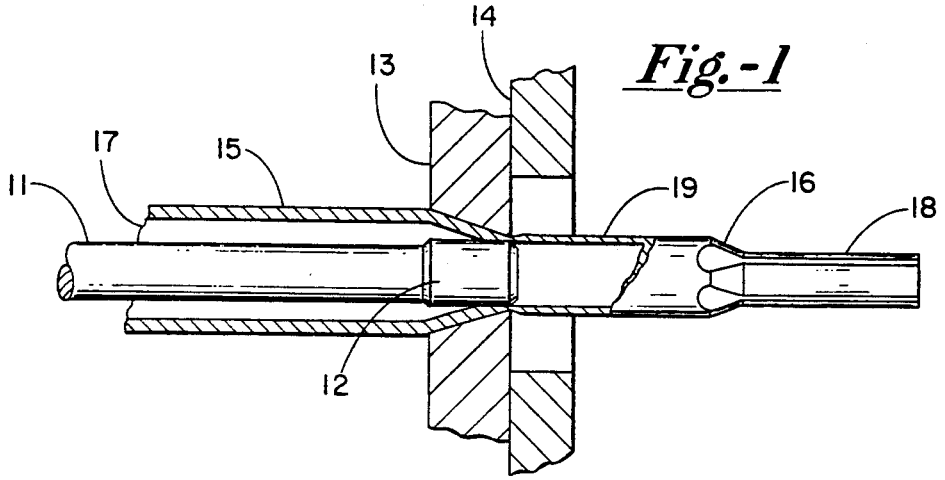
Fig.-1
Fig.-2
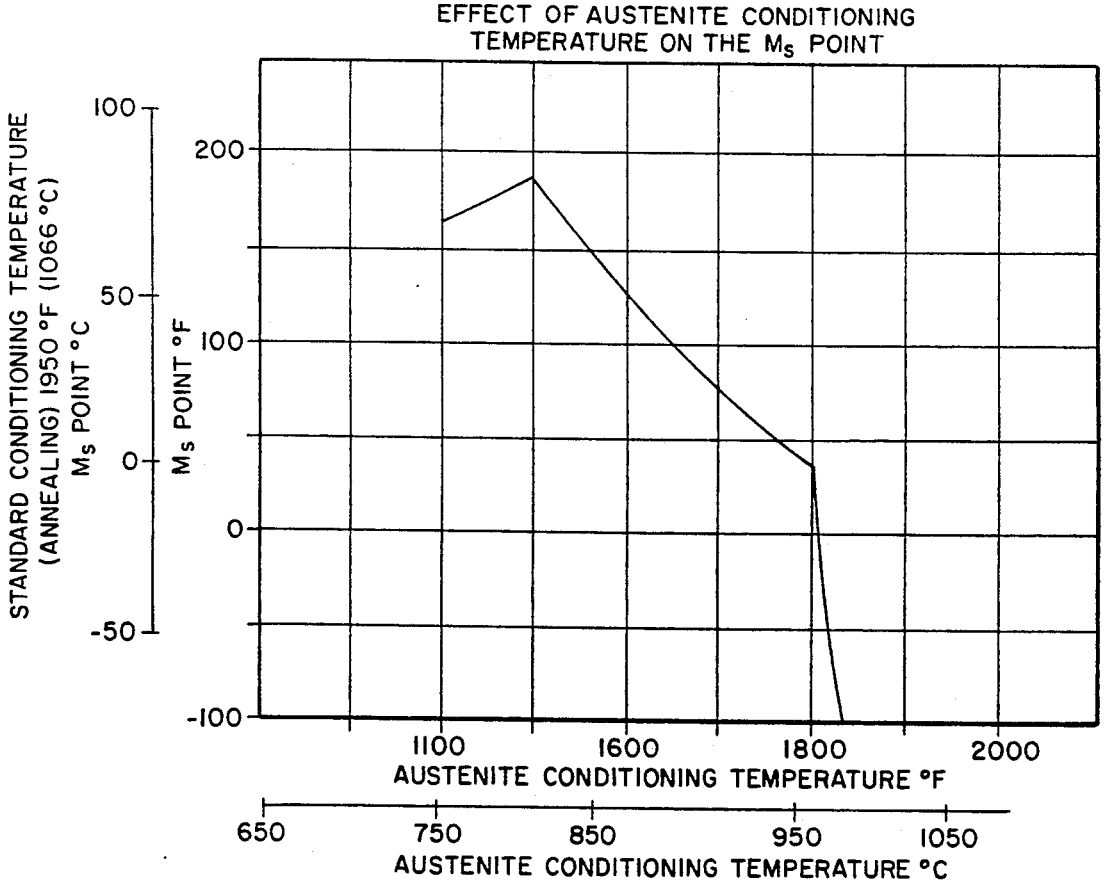

MECHANICAL PROPERTY COMPARISON 17-7PH
STAINLESS STEEL TUBULAR PRODUCT (L) LONGITUDINAL TEST DIRECTION
(C) CIRCUMFERENTIAL TEST DIRECTION

PROCESS FOR CREATING HIGH STRENGTH TUBING WITH ISOTROPIC MECHANICAL PROPERTIES

CROSS-REFERENCE TO RELATED APPLICATION

Reference is made to a related application, Ser. No. 07/613,076, filed of even date and assigned to the same assignee as the present application. The related application involves an unique alloy steel processing technique for high strength cartridge casings applicable to the same or similar materials.

BACKGROUND OF THE INVENTION

1. Field of the Invention

The present invention identifies and defines a process for creating thin wall tubing members, particularly of steel or alloy steel, having superior mechanical properties in the circumferential direction. In particular, the invention is directed toward providing a family of high strength cartridge case bodies which house 20 mm to 50 mm high velocity projectile assemblies. The discovery of the invention further identifies a previously unknown unwanted anisotropic behavior in the preferred steel material and provides a simple thermal treatment processing solution to restore isotropy in the material and elevate mechanical properties into a superior and functionally acceptable range.

2. Description of the Related Art

Cartridge Case Manufacture

The materials commonly employed for high strength cartridge case bodies are 7000 series aluminum alloys and steel, typically a modified medium carbon material. Patent references by Irmann (U.S. Pat. No. 2,220,652) and Rayle, et al. (U.S. Pat. No. 4,041,868) identify basic fabrication techniques associated with aluminum and steel case manufacture, respectively. The case geometry created by these fabrication techniques is compared to that of the current invention in FIGS. 4–6.

FIG. 4 corresponds to the Irmann cartridge case shown generally at 20. It includes a head section 21, a generally cylindrical wall section 22 of tapered diameter and a mouth 23 of reduced diameter. While generally cylindrical, the side wall tapers gradually from the head 21 to the more abrupt or necked-down transition at 24. The thickness of the side wall 22 denoted at 25 also decreases gradually from the head 21 to the mouth 23. The cartridge of Rayle, et al. is similar in geometry and is illustrated generally at 30 in FIG. 5. It includes a head 31, a tapered diameter wall section 32 and a mouth 33 of reduced diameter. The thickness 34 of the wall 32 also decreases from the head 31 to the mouth 33.

The related art, thus, shows dual diameter tapered wall case products for use in a breech housing with matching geometry. Consequently the cartridge case enters and exits the breech from the same end.

The shape required for the cartridge cases of present invention is one of a constant wall thickness right circular cylinder 40, as shown in FIG. 6. This design is required because the gun systems of interest employ a moving breech. In such a design the fired cartridge case housing must exit the breech from the end opposite that through which it entered.

The importance of elasticity in a cartridge case body is well known. Case body expansion during firing must not result in significant permanent set which would otherwise jam the spent case in the breech. The case body designs identified as related art do in fact change shape during firing but their tapered shape match to the tapered breech profile still allow reliable ejection. Consequently, earlier processes pay no attention to definition and control of circumferential mechanical properties, whereas this parameter is the key feature of the current invention for feed-through breech systems.

Alloy Selection

The cartridges employing the current invention case body are usually fired from land vehicles with crew members in close proximity to the gun and its breech system. Consequently, aluminum alloy case material is not employed as case fracture during firing results in severe aluminum melt down which does considerable breech damage and puts the vehicle crew in danger of injury from its own ammunition.

The 20 mm to 50 mm size ammunition family is the primary class of interest with respect to the present invention. A 17-7PH stainless steel is the preferred material of construction. This material, when properly processed, can provide circumferential yield strength in excess of 170,000 psi while retaining typically 8 percent elongation which is sufficient for cartridge assembly and functional application in the class of interest.

Rayle, et al., cited above, identify a modified medium carbon steel case capable of being heat treated to a range of 150,000 psi to 215,000 psi tensile strength, probably in the longitudinal direction. The 215,000 psi tensile strength value will provide approximately 182,000 psi yield strength which would be in the range of interest for the current invention. However, these high strength values identified by Rayle, et al. are achieved by severe brine quenching from 1600° to 1700° F. followed by tempering. Such a heat-treat process, however, is known to create severe distortion and uncontrolled volume expansion of such a magnitude that they could not be tolerated for fabrication of thin wall right circular cylinder case bodies which are used in feed-through breech systems.

While other materials can be used, as discussed in detail below, 17-7PH stainless steel is preferred for most applications of the invention because it can provide the desired strength and is well known to be isotropic (i.e., mechanical properties of equal value in all directions). The isotropic nature of the material is demonstrated for sheet stock in FIG. 7A, as a semi-austenitic steel, 17-7PH can be roll reduced in thickness up to at least 45 percent area reduction and retain its isotropy when age hardened at 900° F.

While the isotropic nature of the material may endure with regard to rolled sheet stock, as will be explained, drawn welded tubing conventionally heat treated to be high strength cartridge case stock has been found to exhibit decidedly asymmetric yield strength properties. It has been found that, although the material behaves according to published data with respect to dimensional predictability, strength figures do not follow the pattern. The yield strength in the circumferential direction has been found to be much lower than desired and much lower than that in a longitudinal direction, due to the presence of a mechanical property anisotropy which is totally unexpected.

The performance of this and similar materials fabricated into cartridge cases and other high performance tubing parts could be improved substantially if the yield strength could be made isotropic at or near the higher value of the longitudinal strength. Accordingly, it is a primary object of the present invention to provide a heat treating process by which very high strength, high alloy steel tubing can be created which exhibits substantially isotropic yield strength characteristics after cold working.

It is a further object of the present invention to accomplish substantially isotropic yield strength characteristics in alloy steel tubing cartridge case bodies utilizing a relatively inexpensive process which increases the yield strength in the circumferential direction while having little effect on the yield strength in the longitudinal direction in which the tube has been drawn.

SUMMARY OF THE INVENTION

The present invention provides a process by which alloy steel tubing cartridge case bodies can be cold worked and heat treated in a manner which results in very high, isotropic yield strength values. This can be done with materials such as 17-7PH stainless steel tubing which has been austenite conditioned at a temperature of at least 1950° F. which has been discovered to produce anisotropic yield strengths in such shapes pursuant to conventional processing. The process of the invention includes the further discovery that, contrary to what existing steel processing theory and published data predict (FIG. 7A), drawn tubing austenite conditioned case body material made from certain alloy steel materials can be restored to isotropy with respect to circumferential yield strength. These materials include austenitic or semi-austenitic stainless steels, certain nickel base alloys which are precipitation hardenable and other metal alloys that undergo phase transformation and precipitation to increase strength properties. It has been found that the materials can be caused to undergo an unique precipitation reaction. This discovery can be used to restore isotropic mechanical properties to the 17-7PH stainless steel or similar materials after a relatively moderate freeze step.

Specifically, it has been found that metal tubing of the class described, even after being conditioned at a temperature in the range of 1950° F. and subjected to a single-pass draw operation, such as a plug draw, can be subsequently conditioned in a relatively mild freeze step of approximately −100° F. (compared to a predicted required freeze of less than −200° F., see FIG. 2) to complete the austenite to martensite conversion.

The steps in the preferred treatment process in accordance with the present invention, then, include an annealing step in which the material is conditioned at approximately 1950° F. for about 15 minutes and thereafter cooled to room temperature. The material is then subjected to a plug draw operation which accomplishes an area reduction of up to about 40%. This is followed by a freezing step in which the material is held at about −100° F. for about one hour. The material is then reconditioned at an elevated temperature of approximately 900° F. for about one-half to one hour.

BRIEF DESCRIPTION OF THE DRAWINGS

In the drawings:

FIG. 1 is a fragmentary view, partially in section, that illustrates a plug drawing apparatus which can be used in accordance with the process of the invention;

FIG. 2 is a plot showing the effect of the austenite conditioning temperature on the $M_s$ point;

DETAILED DESCRIPTION

Figure 3A:
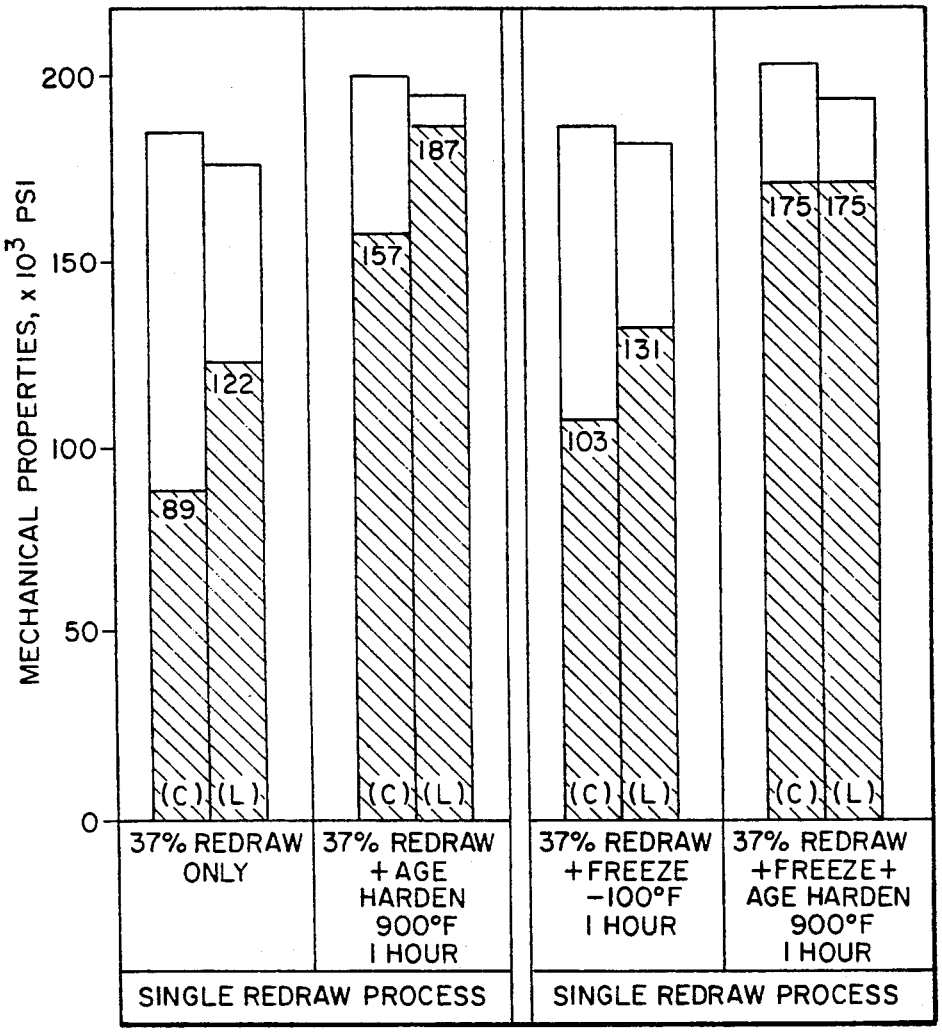
FIG. 3A is a bar graph which shows a mechanical property comparison of a 17-7 PH stainless steel tubular product subjected to different treatment processes.
Figure 3C:
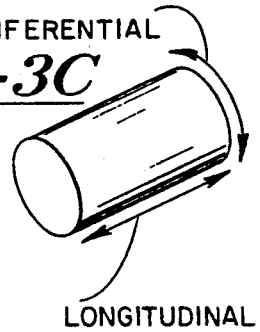
FIG. 3B and 3C are keys for FIG. 3A.
Figure 3B:
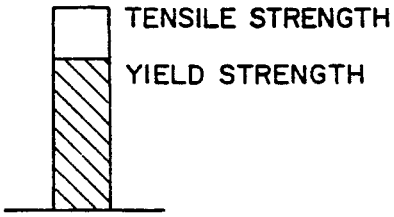
Figure 4:
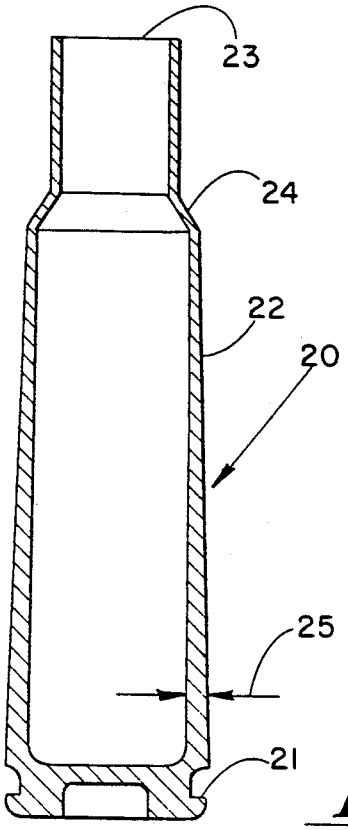
Fig.-4 (PRIOR ART)
FIGS. 4 and 5 illustrate prior art cartridge cases.
Figure 5:
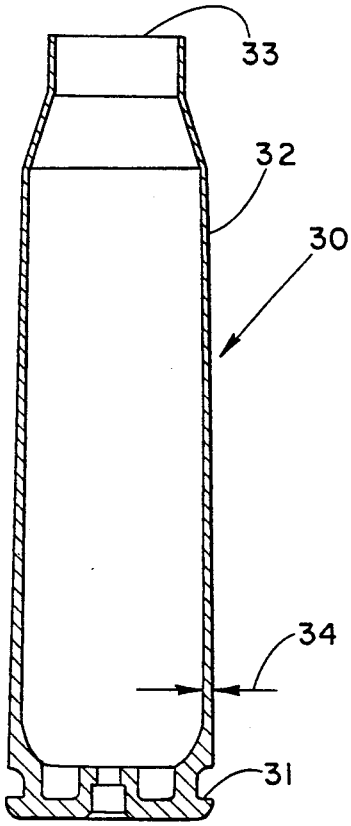
Fig.-5 (PRIOR ART)
Figure 6:
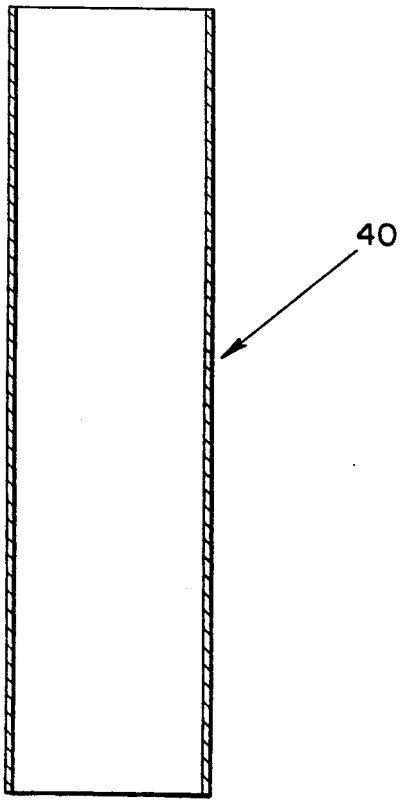
FIG. 6 illustrates a cartridge casing stock in accordance with the invention.
Figure 7A:
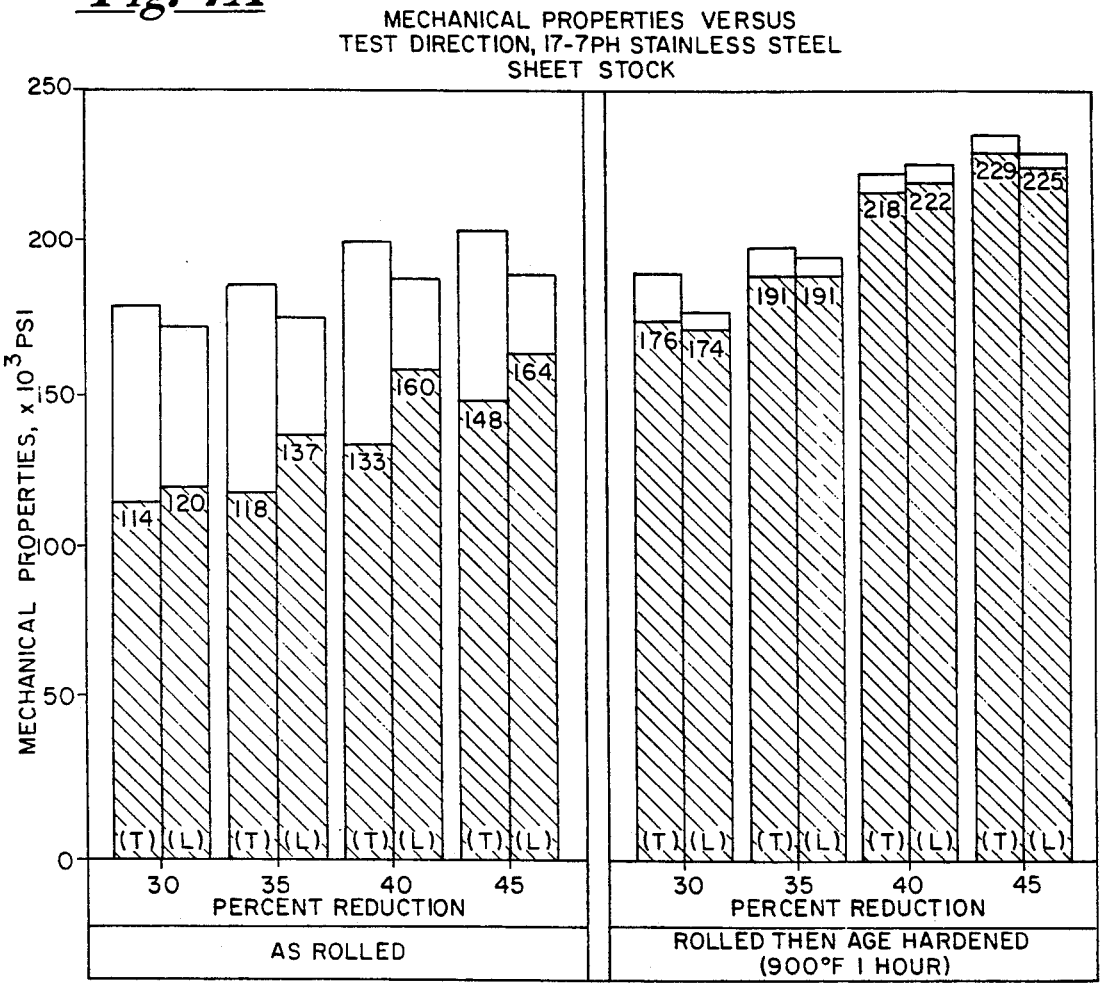
FIG. 7A represents theoretical or handbook values of certain mechanical properites of the metal of the preferred embodiment.
Figure 7B:
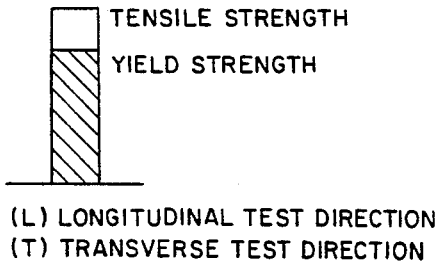
FIG. 7B is a key for FIG. 7A.

The following description illustrates the principle of the cartridge case stock fabrication of the present invention with respect to one or more specific alloy steels. Prior to discussing specific details of the invention process itself, however, it is believed that some definitions and discussion of metal processing would be helpful.

Metal Structure

Iron and iron alloys exhibit several crystal lattice forms with respect to the position of the iron atoms in the structure. Austenite is one form defined as a solid solution of one or more elements in face-centered cubic iron. Although it may include other elements such as nickel and/or chromium, the solute is generally assumed to be carbon. Martensite, on the other hand, is defined as a metastable phase of steel formed by the transformation of austenite which occurs below an initial transition temperature known as the $M_s$ temperature. Martensite is an interstitial supersaturated solid solution of carbon and iron which has a body-centered tetragonal lattice. Its microstructure is characterized by an acicular or needle-like pattern. Transformation from the face-centered to the body-centered form is normally accompanied by a volume expansion of the material.

Processing

Mechanical processes applied to ambient or near ambient temperature metals, of course, are known as cold working. Cold working may be defined as deforming metal plastically at a temperature lower than its recrystallization temperature. The recrystallization temperature, in turn, can be defined as the approximate minimum elevated temperature at which complete formation of a new strain-free grain structure from that existing after cold working occurs within a specified time. Cold working of many steels greatly increases the tensile and yield strengths of the material and very high tensile and yield strengths are desirable in high performance cartridge applications because of the tremendous momentary heat and pressure generated during firing.

Cold working of the tubing associated with the manufacture of cartridge cases may include one or more cold draw steps to achieve the desired diameter and wall thickness dimensions. This usually includes one or more plug draw steps which may be followed by sink drawing.

In the plug drawing operation, the tubing is pulled through a shaping die which defines the outside dimension in conjunction with a stationary mandrel having a plug located adjacent the opening in the die such that the die and plug cooperate to determine the wall thickness of the tube being drawn. One end of the mandrel is a rod fixed to a support beyond the end of the tube being drawn and the other end of the rod is connected to the plug such that the plug is supported by the rod and is held stationary relative to the motion of the tube over the plug between the plug and the die. The geometry of the plug is such that the combination of stresses involved holds the plug in the proper concentric position. The results in terms of inside diameter, surface condition and wall thickness tolerances are of such quality that the operation may be used for a final pass to a finished size. Normally area reductions of up to about forty percent (40%) can be accomplished by a single plug draw operation.

Sink drawing involves pulling the tube through a die formed in the desired shape of the outside diameter without any internal support or plug. Sink drawing may be used after plug drawing for the final adjustment of outside sizing with or without any corresponding change in wall thickness and normally produces an article suitable for final finishing processes.

Prior to drawing it is necessary for the material to be made rather uniformly soft and ductile; therefore, it is normal to subject the metal or metal alloy material to a standard conditioning or annealing step in which the material is held at a suitable elevated temperature for a short time and allowed to cool to ambient. In the case of materials of the class for which the present invention best applies, such as austenitic stainless steels, this is known as the austenitic conditioning temperature and is between about 1850° F. and 2000° F.

One of many types of cold working devices is illustrated in the fragmentary view of FIG. 1 which shows the metal working portion of a plug draw machine partially in section. The device includes a stationary rod member 11 which supports or carries a stationary, internal diameter defining plug member 12 positioned in the tube of interest 15 prior to drawing. The plug member 12 cooperates with an external die 13 fixed to a structure 14 to determine the thickness and diameter of the tube after the drawing operation. Prior to the drawing operation, one end of the tube 15 is reduced or pointed as by swaging at 16 to facilitate its entry into the opening in the die member 13.

In operation, the plug member 12 with retaining rod 11 are inserted into the unswaged open-end 17 of a section of tubing and mounted in a manner such as the rod 11 is fixed in place relative to the motion of the tube 15 during the drawing operation. A member 18 is utilized to pull the member 15 through the die 13 with the plug 12 positioned inside the die so as to produce the desired inside diameter and wall thickness in the drawn part of the tube 19. Geometry of the plug 12 is normally such that a combination of stresses holds the plug in the proper centered position with respect to the tube. A great deal of stress may be generated during the drawing operation in which the member 15 is pulled through the die past the plug in the reduction operation. The metal plastically deforms in a uniform manner taking on new permanent dimensions.

Process of the Invention

A basic tube plug drawing procedure is preferably used to create the cartridge case body material. The 17-7PH stainless steel tubing is first solution annealed at approximately 1950° F. for 15 minutes then cooled to room temperature. Any distortions created by annealing are easily removed during subsequent drawing operations.

This solution annealed material is essentially austenitic at this point and is soft and ductile. The solution anneal treatment has depressed the $M_s$ temperature (the temperature at which austenite transforms to martensite), to something less than −200° F. A published curve (Armco Steel Databook, 1975) showing this phenomena is presented as FIG. 2.

To achieve the high yield strength properties desired for the cartridge body application the austenite must be transformed to martensite followed by low temperature (900° F.), precipitation hardening. This transformation occurs during plug drawing the 17-7PH stainless steel tubing to final wall thickness and diameter. A sink draw finishing step may also be employed if desired to precisely adjust the finish diameter.

Since cold worked 17-7PH stainless steel undergoes a modest and predictable shrinkage when precipitation hardened, it was believed that this tubular product need be only cut to length then age hardened after drawing to achieve the desired dimensional detail and minimum yield strength in the circumferential direction.

This assumption was proved to be true for the dimensional detail but the resulting yield strength in the circumferential direction was found to be much lower than desired due to the totally unexpected presence of mechanical property anisotropy. The following Examples further illustrates this discovery. Thereafter, a process modification to the thermal treatment in accordance with the invention will be discussed which corrected the anisotropic condition.

EXAMPLE 1

This example identifies a certain 30 mm size product test series cartridge case. In order for this particular 30 mm size case to function without sticking after being fired, a 170,000 psi yield strength must be created in the circumferential direction. A 37 percent area reduction single pass plug draw was employed after annealing. The drawn material was age hardened at 900° F. for one hour. As illustrated in FIG. 3A, yield strength testing in the longitudinal and circumferential direction after age hardening produced a result quite contrary to the established isotropic theory. Anisotropy (mechanical properties significantly lower in the circumferential direction) was found. The resultant typical yield strength of 157,000 psi was created, well below the required minimum.

EXAMPLE 2

In accordance with the invention, samples from the same lot of tubes as those that achieved the 157,000 psi value after age hardening were conditioned at −100° F. for one hour prior to age hardening. Tensile tests taken after subsequent age hardening show that a substantial yield strength improvement occurred and isotropy was achieved as substantially equal yield strength values were achieved in the longitudinal and circumferential direction. This result is also shown in FIG. 3A.

The explanation for the creation or restoration of isotropy and the elevation of the circumferential yield strength is noteworthy. Contrary to published data derived expectation, the tube drawing apparently creates anisotropy leaving circumferential yield strength much lower than expected. The plug draw reduction process, however, also elevates the $M_s$ temperature such that martensite transformation from austenite can be accomplished with a freezing treatment in the −100° F. range. Further, this improvement in martensite transformation is preferential as evidenced by dimensional change data taken on partial lengths of the same tube either precipitation hardened or −100° F. treated then precipitation hardened. This data, presented in Table I, indicates much greater change in volume expansion for the circumferential direction when compared to the longitudinal direction when given the −100° F. treatment.

TABLE I.

Size Change Analysis
(values are in inches per inch)

| Measurement Direction | | |
|---|---|---|
| Circumference | Length | Hardening Treatment |
| −.00021 | −.00060 | Precipitation treat 900° F., 1 hour. |
| +.00113 | −.00015 | Freeze −100° F., 1 hour plus precipitation treat 900° F. 1 hour. |

It has thus been discovered that tubular product alloy steels of the class including high nickel, semi-austenitic stainless steels, exemplified by 17-7 PH and PH 15-7 MO, cold worked austenitic stainless steels, exemplified by 301, 302 and 304 stainless steels, and any metal alloy that undergoes phase transformation and precipitation to increase strength properties, can be conditioned at a prescribed temperature then cold drawn, and yet undergo complete martensitic transformation utilizing a freeze step no lower than −100° F. The tubes which have undergone the freeze, then age hardening, steps in the process exhibit much higher circumferential yield strength than those tubes age hardened only. In fact, when one compares the circumferential and longitudinal yield strengths of materials treated in accordance with the process of the present invention, as exemplified in the data of Table II, the anisotropic nature substantially disappears and is replaced by a very high strength isotropic yield strength. This is highly desirable from the standpoint of the applications with which the invention is particularly concerned. Thus, it can be seen that the equalization in strength occurs at or above the higher, initial longitudinal value rather than at the original low circumferential yield strength.

TABLE II.

17-7 Stainless Steel Tube Age-Hardened (900° F., One Hour) Test Results
(By Test Direction and Weld Included or Not)

| Comment | Calc. % of Red. of Area | Tube Sample Number | TS, KSI | YS, KSI | % Elong. | Rock. Hdnss. 30N | TS, KSI | YS, KSI | % Elong. | Rock. Hdnss. A |
|---|---|---|---|---|---|---|---|---|---|---|
| | | | Circumferential - Weld* | | | | Longitudinal - Weld* | | | |
| Half of X | 37.4 | H640-2 | 204.6 | 160.4 | 14 | 59.8 | 208.9 | 204.4 | 17 | 64.9 |
| Pdctn. | 37.5 | H640-5 | 198.4 | 157 | 14 | 59.8 | 193.5 | 185.2 | 19 | 61.6 |
| Run: Four | 36.8 | H640-6 | 199.1 | — | 15.5 | 60 | 197.2 | 192.4 | 17.5 | 62.7 |
| Tubes | 37.1 | H640-13 | 202.7 | 164.1 | 14 | 60.1 | 200.2 | 196.6 | 17 | 63.2 |
| Age Harden Only | | | | | | | | | | |
| Half of | 37.5 | H640-5 | | | | | | | | |
| Pdctn. | 37.5 | H640-5 | 208.7 | 180.3 | 12 | 65.2 | NO DATA TAKEN | | | |
| Run: Four | 36.8 | H640-6 | 204.7 | 175.2 | 11 | 65.3 | | | | |
| Tubes | 37.4 | H640-2 | 202.5 | 170.6 | 13.5 | 64.4 | | | | |
| Freeze at −100° F. Then Age Harden | 37.1 | H640-13 | 209.4 | 178.7 | 14 | 65.1 | | | | |
| *Tensile bar sample includes the weld zone. | | | | | | | | | | |
| | | | Circumferential - No Weld* | | | | Longitudinal - No Weld* | | | |
| Half of X | 37.4 | H640-2 | 201.4 | 153.3 | 14 | 60.4 | 185.2 | 174.8 | 17 | 59.9 |
| Pdctn. | 37.5 | H640-5 | 198.5 | 145.7 | 15.5 | 60.3 | 187.6 | 177.5 | 17 | 60.7 |
| Run: Four | 36.8 | H640-6 | 196.3 | 152.3 | 15.5 | 60.8 | 192.6 | 185.1 | 18.5 | 61.4 |
| Tubes | 37.1 | H640-13 | 201.6 | 163.6 | 17 | 61.4 | 192.1 | 181.2 | 20 | 61.4 |
| Age Only | | | | | | | | | | |
| Half of | 37.5 | H640-5 | 217.4 | 184.5 | 13 | 65.5 | 194.4 | 174.2 | 18 | 65.7 |
| Pdctn. | 37.5 | H640-5 | 207.1 | 172.9 | 14 | 65.1 | 198.0 | 180.1 | 17.5 | 64.9 |
| Run: Four | 36.8 | H640-6 | 203.9 | 169.4 | 14.5 | 64.9 | 189.6 | 178.4 | 16 | 64.8 |
| Tubes | 37.4 | H640-2 | 205.8 | 172.4 | 14 | 63.9 | 198.9 | 178.3 | 18.5 | 64.8 |
| Freeze at −100° F. Then Age Harden | 37.1 | H640-13 | 207 | 173.7 | 14.5 | 65 | 192.0 | 167.7 | 17 | 64.6 |

*Tensile bar sample does not include weld zone.

This invention has been described in this application in considerable detail in order to comply with the Patent Statutes and to provide those skilled in the art with the information needed to apply the novel principles and to construct and use such specialized components as are required. However, it is to be further understood that the invention can be carried out by specifically different equipment and devices and that various modifications, both as to equipment details and operating procedures, can be accomplished without departing from the scope of the invention itself.

The present invention, then, identifies anisotropy in a 17-7PH stainless steel, a material previously believed to be isotropic, and identifies a thermal treatment procedure that preferentially elevates mechanical properties to achieve material isotropy. This discovery can be very useful for 17-7PH stainless steel cartridge case body material but is not limited to just this alloy or application. Any metal which undergoes phase transformation during work hardening is a candidate for this procedure. The 302, 304, 316 and PH15-7MO stainless steels are but a few examples that fall in this class. Cold formed or deep drawn products made from sheet stock could benefit from this discovery. In addition, wire products in these materials used for spring applications could see substantial improvement in spring rate value and consistency.

What is claimed is:

1. A method of processing cartridge case stock to precise dimensions, the stock being formed of alloy steel which undergo a phase transformation and precipitation to increase strength properties, to impart high isotropic yield strength properties to tubing for use in high performance cartridge cases, or the like, consisting essentially of the steps of:

austenitic conditioning the alloy steel at a temperature above about 1800° F. sufficient to cause the $M_s$ point to drop below about −100° F.;

cold working the alloy steel by subjecting it to a cold working reduction operation having desired dimensional tolerances;

refrigerating the alloy steel at a temperature at or about −100° F. for a predetermined time; and age hardening the alloy steel by heating it to a temperature below the transition temperature for a predetermined time.

2. The method of claim 1 wherein the metal is selected from a group consisting of semi-austenitic stainless steels and cold worked austenitic stainless steels.

3. The method of claim 2 wherein said metal is selected from 17-7 PH, PH 15-7 MO, 301, 302, 304 stainless steels.

4. The method of claim 3 wherein said metal is 17-7 PH semi-austenitic stainless steel.

5. The method of claim 3 wherein said austenitic conditioning temperature is about 1950° F.

6. The method of claim 4 wherein said austenitic conditioning temperature is about 1950° F.

7. The method of claim 6 wherein said age hardening is carried out at a temperature of about 900° F.

8. The method of claim 1 wherein said cold working operation consists of a single pass plug draw.

9. The method of claim 5 wherein said cold working operation consists of a single pass plug draw.

10. The method of claim 1 wherein the age hardening step is carried out at approximately 900° F.

11. The method of claim 1 wherein the alloy steel is frozen for about one hour.

12. The method of claim 1 wherein the austenitic conditioning temperature is about 1950° F.

13. A method of processing alloy steel into high strength tubing of high dimensional precision for use as high performance cartridge cases for feed-through breech systems, or the like, consisting essentially of the steps of:

austenitic conditioning the alloy steel at a temperature in the range of about 1850° F. to 2000° F. sufficient to cause the $M_s$ point to drop below about −100° F.;

cold working the alloy-steel by subjecting it to a cold working reduction operation to produce the desired diameter precision;

refrigerating the alloy steel at a temperature at or about −100° F. for approximately one hour;

age hardening the alloy steel by heating it to a temperature of approximately 800° F. to 950° F. but below the transition temperature for a time from about one-half to one hour; and wherein the alloy steel is selected from a group consisting of high nickel stainless steels, semi-austenitic stainless steels and cold worked austenitic stainless steels.

14. A method of processing alloy steel into high strength tubing of high dimensional precision for use in high performance cartridge cases, or the like, consisting essentially of the steps of:

austenitic conditioning the alloy steel at a temperature in the range of about 1850° F. to about 2000° F. for a predetermined time;

subjecting the alloy steel to a single pass drawing operation accompanied by a reduction of approximately 35% to 40%;

subjecting the alloy steel to a cryogenic step in which it is frozen to approximately −100° F. for a predetermined time;

age hardening the alloy steel by heating it to a temperature in the range of 800° F. to 950° F. for a predetermined time; and wherein the alloy steel is selected from a group consisting of high nickel stainless steels, semi-austenitic stainless steels and cold worked austenitic stainless steels.

15. The process of claim 14 wherein the austenite conditioning temperature is about 1950° F. and the age hardening temperature is approximately 900° F.

16. The process of claim 15 wherein the predetermined time of the austenitic conditioning is approximately one-quarter hour and the predetermined time for age hardening is about one-half to one hour.

17. The method of claim 16 wherein the alloy steel is selected from 17-7 PH and PH 15-7 MO high nickel stainless steels, semi-austenitic stainless steel.

18. The method of claim 16 wherein the alloy steel is 17-7PH stainless steel.

* * * * *